US010910698B2

(12) United States Patent
Wei et al.

(10) Patent No.: US 10,910,698 B2
(45) Date of Patent: Feb. 2, 2021

(54) MOBILE DEVICE AND ANTENNA STRUCTURE

(71) Applicant: Wistron NeWeb Corp., Hsinchu (TW)

(72) Inventors: Shih-Chiang Wei, Hsinchu (TW); Cheng-Da Yang, Hsinchu (TW); Kuan-Hung Li, Hsinchu (TW); Shu-Yun Yeh, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 16/669,732

(22) Filed: Oct. 31, 2019

(65) Prior Publication Data

US 2020/0274231 A1 Aug. 27, 2020

(30) Foreign Application Priority Data

Feb. 22, 2019 (TW) ..... 108105956 A

(51) Int. Cl.

| | |
|---|---|
| ***H01Q 5/30*** | (2015.01) |
| ***H01Q 1/24*** | (2006.01) |
| ***H01Q 5/357*** | (2015.01) |
| ***H01Q 5/385*** | (2015.01) |

(52) U.S. Cl.

CPC ..... *H01Q 1/244* (2013.01); *H01Q 5/357* (2015.01); *H01Q 5/385* (2015.01)

(58) Field of Classification Search

CPC ..... H01Q 1/24; H01Q 1/38; H01Q 5/378–5/385; H01Q 13/10

See application file for complete search history.

(56) References Cited

U.S. PATENT DOCUMENTS

| | | | | |
|---|---|---|---|---|
| 6,876,329 | B2 * | 4/2005 | Milosavljevic | H01Q 1/243 343/700 MS |
| 7,876,274 | B2 * | 1/2011 | Hobson | H01Q 1/243 343/702 |
| 9,172,142 | B2 * | 10/2015 | Sudo | H01Q 19/28 |

(Continued)

FOREIGN PATENT DOCUMENTS

| | | | |
|---|---|---|---|
| TW | 201703350 | A | 1/2017 |
| TW | M537316 | U | 2/2017 |
| TW | I646729 | B | 1/2019 |

*Primary Examiner* — Hasan Z Islam

(74) *Attorney, Agent, or Firm* — McClure, Qualey & Rodack, LLP

(57) ABSTRACT

A mobile device includes a metal mechanism element, a dielectric substrate, a holder, a feeding radiation element, a ground plane, a shorting element, a circuit element, a first parasitic radiation element, a second parasitic radiation element, and an additional radiation element. The metal mechanism element has a slot. The ground plane and the shorting element are respectively coupled to the metal mechanism element. The circuit element is coupled between the shorting element and the ground plane. The first parasitic radiation element and the second parasitic radiation element are respectively coupled to the ground plane. The additional radiation element is adjacent to the feeding radiation element or is coupled to the feeding radiation element. An antenna structure is formed by the feeding radiation element, the circuit element, the first parasitic radiation element, the second parasitic radiation element, the additional radiation element, and the slot of the metal mechanism element.

20 Claims, 12 Drawing Sheets

(56) References Cited

U.S. PATENT DOCUMENTS

| | | | | |
|---|---|---|---|---|
| 9,190,713 | B2 * | 11/2015 | Eom | H01Q 1/243 |
| 10,056,696 | B2 | 8/2018 | Tseng et al. | |
| 2014/0066126 | A1 | 3/2014 | Asrani et al. | |
| 2017/0005414 | A1 | 1/2017 | Yang | |
| 2018/0351254 | A1 | 12/2018 | Yen et al. | |

* cited by examiner

MOBILE DEVICE AND ANTENNA STRUCTURE

CROSS REFERENCE TO RELATED APPLICATIONS

This application claims priority of Taiwan Patent Application No. 108105956 filed on Feb. 22, 2019, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2GHz, and 5.8 GHz.

In order to improve their appearance, designers often incorporate metal elements into mobile devices. However, these newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In an exemplary embodiment, the disclosure is directed to a mobile device which includes a metal mechanism element, a dielectric substrate, a holder, a feeding radiation element, a ground plane, a shorting element, a circuit element, a first parasitic radiation element, a second parasitic radiation element, and an additional radiation element. The metal mechanism element has a slot. The slot has a first closed end and a second closed end. The dielectric substrate has a first surface and a second surface which are opposite to each other. The holder is disposed on the metal mechanism element and is configured to support the dielectric substrate. The feeding radiation element has a feeding point. The feeding radiation element covers at least one portion of the slot. The ground plane is coupled to the metal mechanism element. The shorting element is coupled to the metal mechanism element. The circuit element is coupled between the shorting element and a first grounding point on the ground plane. The feeding radiation element, the ground plane, the shorting element, and the circuit element are all disposed on the second surface of the dielectric substrate. The first parasitic radiation element is coupled to a second grounding point on the ground plane. The second parasitic radiation element is coupled to a third grounding point on the ground plane. The additional radiation element is adjacent to or coupled to the feeding radiation element. The first parasitic radiation element, the second parasitic radiation element, and the additional radiation element are all disposed on the first surface of the dielectric substrate. An antenna structure is formed by the feeding radiation element, the circuit element, the first parasitic radiation element, the second parasitic radiation element, the additional radiation element, and the slot of the metal mechanism element.

In some embodiments, each of the ground plane and the shorting element is a ground copper foil extending from the metal mechanism element onto the second surface of the dielectric substrate.

In some embodiments, the feeding radiation element substantially has a geometric shape.

In some embodiments, the slot has a first side and a second side which are opposite to each other. The feeding radiation element extends across at least the first side of the slot.

In some embodiments, the feeding radiation element has a specific side which is far away from the feeding point, and the specific side is substantially aligned with at least one side of the additional radiation element.

In some embodiments, the mobile device further includes a first conductive via element penetrating the dielectric substrate. The first parasitic radiation element is coupled through the first conductive via element to the second grounding point.

In some embodiments, at least one of the first parasitic radiation element and the second parasitic radiation element substantially has an L-shape.

In some embodiments, the mobile device further includes a second conductive via element penetrating the dielectric substrate. The second parasitic radiation element is coupled through the second conductive via element to the third grounding point.

In some embodiments, the second parasitic radiation element further includes a first widening portion. The first widening portion covers at least one portion of the slot.

In some embodiments, at least one portion of the additional radiation element substantially has a straight-line shape which is substantially parallel to the slot.

In some embodiments, the additional radiation element further includes a second widening portion. The second widening portion has a vertical projection on the second surface of the dielectric substrate, and the vertical projection at least partially overlaps the feeding radiation element.

In some embodiments, the additional radiation element is floating and does not directly touch the feeding radiation element.

In some embodiments, the antenna structure covers a first frequency band, a second frequency band, a third frequency band, a fourth frequency band, and a fifth frequency band. The first frequency band is from 699 MHz to 960 MHz. The second frequency band is from 1710 MHz to 2170 MHz. The third frequency band is from 2200 MHz to 2690 MHz. The fourth frequency band is from 3400 MHz to 4300 MHz. The fifth frequency band is from 5150 MHz to 5925 MHz.

In some embodiments, the length of the slot is shorter than 0.48 wavelength of the first frequency band.

In some embodiments, the length of the first parasitic radiation element is substantially equal to 0.25 wavelength of the second frequency band.

In some embodiments, the length of the second parasitic radiation element is substantially equal to 0.25 wavelength of the second frequency band.

In some embodiments, the length of the additional radiation element is substantially equal to 0.25 wavelength of the third frequency band.

In some embodiments, the circuit element is a resistor, an inductor, a capacitor, a switch element, or a combination thereof.

In some embodiments, the mobile device further includes an auxiliary radiation element coupled to the additional radiation element. The auxiliary radiation element is disposed on the first surface of the dielectric substrate. The auxiliary radiation element substantially has a straight-line shape.

In another exemplary embodiment, the disclosure is directed to an antenna structure which includes a metal mechanism element, a dielectric substrate, a holder, a feeding radiation element, a ground plane, a shorting element, a circuit element, a first parasitic radiation element, a second parasitic radiation element, and an additional radiation element. The metal mechanism element has a slot. The slot has a first closed end and a second closed end. The dielectric substrate has a first surface and a second surface which are opposite to each other. The holder is disposed on the metal mechanism element and is configured to support the dielectric substrate. The feeding radiation element has a feeding point. The feeding radiation element covers at least one portion of the slot. The ground plane is coupled to the metal mechanism element. The shorting element is coupled to the metal mechanism element. The circuit element is coupled between the shorting element and a first grounding point on the ground plane. The feeding radiation element, the ground plane, the shorting element, and the circuit element are all disposed on the second surface of the dielectric substrate. The first parasitic radiation element is coupled to a second grounding point on the ground plane. The second parasitic radiation element is coupled to a third grounding point on the ground plane. The additional radiation element is adjacent to or coupled to the feeding radiation element. The first parasitic radiation element, the second parasitic radiation element, and the additional radiation element are all disposed on the first surface of the dielectric substrate.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . .". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
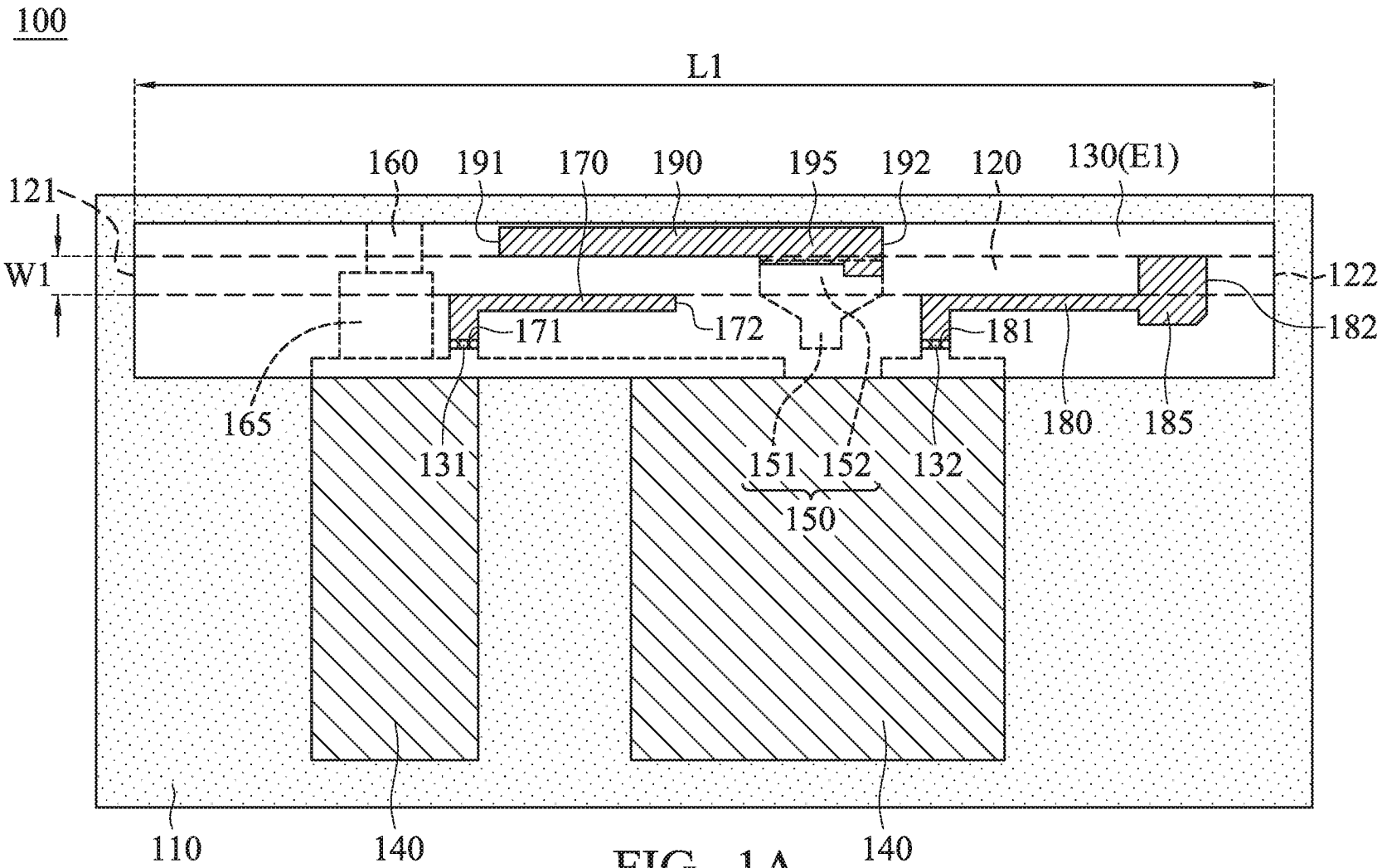
FIG. 1A is a top view of a mobile device according to an embodiment of the invention.

FIG. 1A is a top view of a mobile device 100 according to an embodiment of the invention. For example, the mobile device 100 may be a smartphone, a tablet computer, or a notebook computer. As shown in FIG. 1A, the mobile device 100 at least includes a metal mechanism element 110, a holder 115, a dielectric substrate 130, a ground plane 140, a feeding radiation element 150, a shorting element 160, a circuit element 165, a first parasitic radiation element 170, a second parasitic radiation element 180, and an additional radiation element 190. The ground plane 140, the feeding radiation element 150, the shorting element 160, the first parasitic radiation element 170, the second parasitic radiation element 180, and the additional radiation element 190 may all be made of metal materials, such as copper, silver, aluminum, iron, or their alloys. It should be understood that the mobile device 100 may further include a touch control panel, a display device, a speaker, a battery module, and/or a housing although they are not displayed in FIG. 1A. In alternative embodiments, FIG. 1A is considered as an antenna structure including all of the components of the mobile device 100.

The dielectric substrate 130 may be an FR4 (Flame Retardant 4) substrate, a PCB (Printed Circuit Board), or an FCB (Flexible Circuit Board). The dielectric substrate 130 has a first surface E1 and a second surface E2 which are opposite to each other. The second surface E2 of the dielectric substrate 130 is adjacent to the slot 120 of the metal mechanism element 110. It should be noted that the term "adjacent" or "close" over the disclosure means that the distance (spacing) between two corresponding elements is smaller than a predetermined distance (e.g., 5 mm or shorter). Specifically, the first parasitic radiation element 170, the second parasitic radiation element 180, and the additional radiation element 190 are all disposed on the first surface E1 of the dielectric substrate 130. The ground plane 140, the feeding radiation element 150, the shorting element 160, and the circuit element 165 are all disposed on the second surface E2 of the dielectric substrate 130.

Figure 1B:
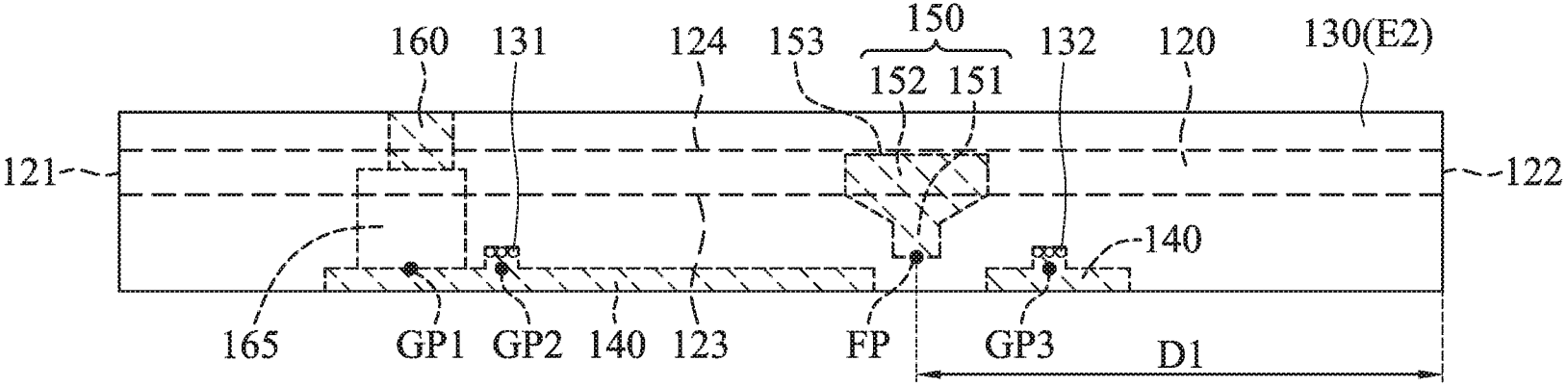
FIG. 1B is a see-through view of a second surface of a dielectric substrate of a mobile device according to an embodiment of the invention.
Figure 1C:
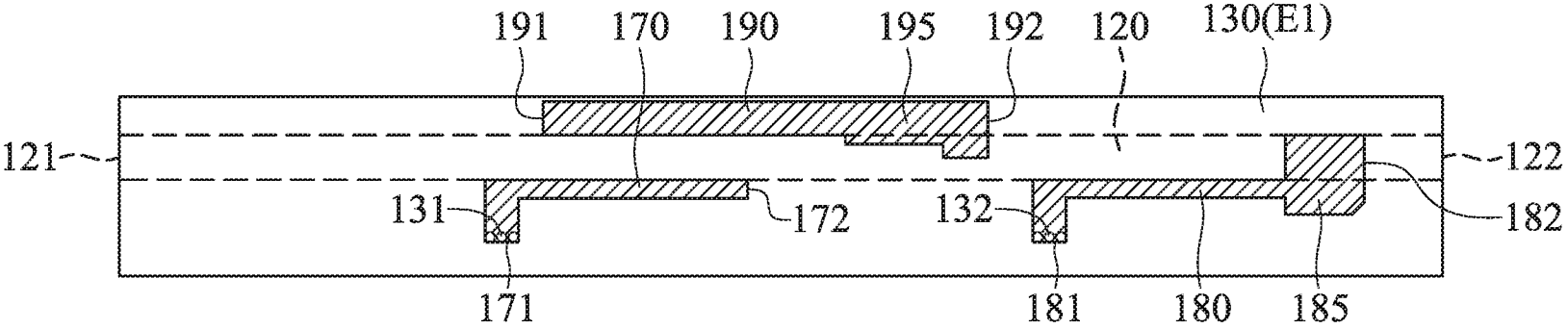
FIG. 1C is a top view of a first surface of a dielectric substrate of a mobile device according to an embodiment of the invention.
Figure 1D:
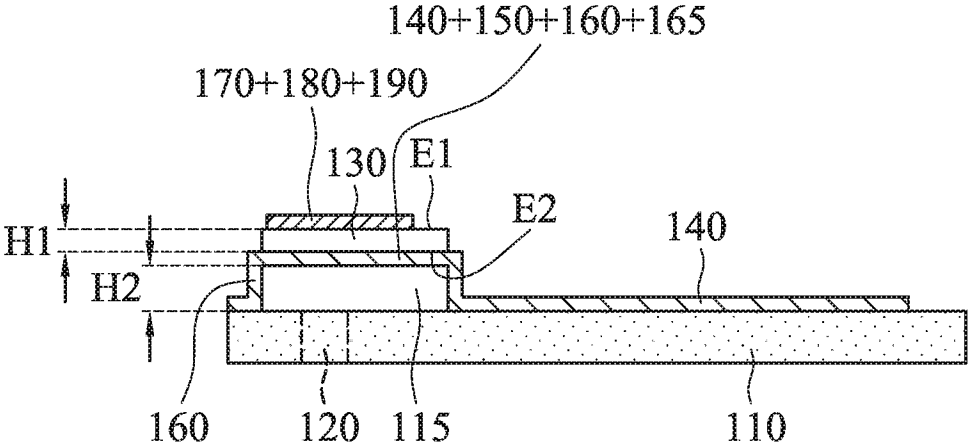
FIG. 1D is a side view of a mobile device according to an embodiment of the invention.

FIG. 1B is a see-through view of the second surface E2 of the dielectric substrate 130 of the mobile device 100 according to an embodiment of the invention (i.e., the dielectric substrate 130 is considered as a transparent element). FIG. 1C is a top view of the first surface E1 of the dielectric substrate 130 of the mobile device 100 according to an embodiment of the invention. FIG. 1D is a side view of the mobile device 100 according to an embodiment of the invention. Please refer to FIG. 1A, FIG. 1B, FIG. 1C, and FIG. 1D together, so as to make the invention more easily understood.

The metal mechanism element 110 may be a metal housing of the mobile device 100. In some embodiments, the metal mechanism element 110 is a metal upper cover of a notebook computer or a metal back cover of a tablet computer, but it is not limited thereto. For example, if the mobile device 100 is a notebook computer, the metal mechanism element 110 may be the so-called "A-component" in the field of notebook computers. The metal mechanism element 110 has a slot 120. The slot 120 of the metal mechanism element 110 may substantially have a straight-line shape. Specifically, the slot 120 has a first closed end 121 and a second closed end 122 which are far away from each other. The mobile device 100 may further include a nonconductive material, which fills the slot 120 of the metal mechanism element 110, so as to provide the functions of waterproof or dustproof.

The holder 115 may be made of a nonconductive material, such as a plastic material. The holder 115 is disposed on the metal mechanism element 110 and is configured to support and fix the dielectric substrate 130 and all of the components thereon. The dielectric substrate 130 extends across the slot 120 of the metal mechanism element 110. The ground plane 140 may be a ground copper foil, which may substantially have a stepped-shape. For example, the ground plane 140 may be coupled to the metal mechanism element 110, and the ground plane 140 may extend from the metal mechanism element 110 onto the second surface E2 of the dielectric substrate 130. The shorting element 160 may be another ground copper foil, which may substantially have another stepped-shape. For example, the shorting element 160 may be coupled to the metal mechanism element 110, and the shorting element 160 may extend from the metal mechanism element 110 onto the second surface E2 of the dielectric substrate 130. In some embodiments, an antenna structure is formed by the feeding radiation element 150, the circuit element 165, the first parasitic radiation element 170, the second parasitic radiation element 180, the additional radiation element 190, and the slot 120 of the metal mechanism element 110.

The feeding radiation element 150 may substantially have a T-shape. The feeding radiation element 150 covers at least one portion of the width W1 or the whole width W1 of the slot 120. That is, the feeding radiation element 150 has a vertical projection on the metal mechanism element 110, and the vertical projection of the feeding radiation element 150 at least partially overlaps the slot 120. In some embodiments (please refer to FIG. 1B), the slot 120 has a first side 123 and a second side 124 which are opposite to each other. The feeding radiation element 150 extends across at least the first side 123 of the slot 120, and the feeding radiation element 150 is close to or extends across the second side 124 of the slot 120. Specifically, the feeding radiation element 120 has a variable-width structure which includes a narrow portion 151 and a wide portion 152. A feeding point is positioned on the narrow portion 151 of the feeding radiation element 150. The wide portion 152 of the feeding radiation element 150 is coupled through the narrow portion 151 of the feeding radiation element 150 to the feeding point FP. The feeding point FP may be further coupled to a signal source (not shown). For example, the signal source may be an RF (Radio Frequency) module for exciting the antenna structure of the mobile device 100. Furthermore, the feeding radiation element 150 has a specific side 153 which is far away from the feeding point FP and is positioned on the wide portion 152. The specific side 153 is substantially aligned with the second side 124 of the slot 120. In alternative embodiments, the feeding radiation element 150 substantially has a geometric shape, such as a straight-line shape, a trapezoidal shape, or a triangular shape, but it is not limited thereto (please refer to the following embodiments of FIG. 5, FIG. 6, and FIG. 7).

The shorting element 160 substantially has a straight-line shape. The shorting element 160 and the ground plane 140 are respectively positioned on an upper side and a lower side of the slot 120, and are respectively coupled to the metal mechanism element 110. The circuit element 165 is coupled in series between the shorting element 160 and a first grounding point GP1 on the ground plane 140. The circuit element 165 has a vertical projection on the metal mechanism element 110. The vertical projection of the circuit element 165 may at least partially overlap the slot 120, or may be completely inside the slot 120. In some embodiments, the circuit element 165 is a resistor, an inductor, a capacitor, a switch element, or a combination thereof. For example, the aforementioned resistor may be a fixed resistor or a variable resistor, the aforementioned inductor may be a fixed inductor or a variable inductor, and the aforementioned capacitor may be a fixed capacitor or a variable capacitor. In addition, the aforementioned switch element may operate in a closed state or an open state. It should be noted that the circuit element 165 can increase the operation bandwidth of the antenna structure of the mobile device 100, regardless the left side or right side of the feeding radiation element 150 where the circuit element 165 is positioned.

The first parasitic radiation element 170 may substantially have an L-shape. The first parasitic radiation element 170 has a first end 171 and a second end 172. The first end 171 of the first parasitic radiation element 170 is coupled to a second grounding point GP2 on the ground plane 140. The second end 172 of the first parasitic radiation element 170 is an open end. The first parasitic radiation element 170 has a vertical projection on the metal mechanism element 110. The vertical projection of first parasitic radiation element 170 may at least partially overlap the slot 120 of the metal mechanism element 110, or may not overlap the slot 120 of the metal mechanism element 110 at all. In some embodiments, the mobile device 100 further include a first conductive via element 131. The first conductive via element 131 penetrates the dielectric substrate 130, and thus the first end 171 of the first parasitic radiation element 170 is coupled through the first conductive via element 131 to the second grounding point GP2. However, the invention is not limited thereto. In alternative embodiments, the aforementioned first conductive via element 131 is omitted, such that the first end 171 of the first parasitic radiation element 170 is adjacent to the second grounding point GP2 but does not directly touch the ground plane 140. The two different designs can achieve similar operation performance since there is a coupling effect induced between the first parasitic radiation element 170 and the ground plane 140.

The second parasitic radiation element 180 may substantially have an L-shape. The second parasitic radiation element 180 has a first end 181 and a second end 182. The first end 181 of the second parasitic radiation element 180 is coupled to a third grounding point GP3 on the ground plane 140. The second end 182 of the second parasitic radiation element 180 is an open end. The second end 182 of the second parasitic radiation element 180 and the second end 172 of the first parasitic radiation element 170 substantially extend in the same direction. In some embodiments, the second parasitic radiation element 180 further includes a first widening portion 185, which may be positioned at the second end 182 of the second parasitic radiation element 180 and may substantially have a rectangular shape or a square shape. The first widening portion 185 of the second parasitic radiation element 180 can cover at least one portion of the width W1 of the slot 120, or the whole width W1 of the slot 120. That is, the first widening portion 185 has a vertical projection on the metal mechanism element 110, and the vertical projection of the first widening portion 185 at least partially overlaps the slot 120 of the metal mechanism element 110. In some embodiments, the mobile device 100 further includes a second conductive via element 132. The second conductive via element 132 penetrates the dielectric substrate 130, and thus the first end 181 of the second parasitic radiation element 180 is coupled through the second conductive via element 132 to the third grounding point GP3. However, the invention is not limited thereto. In alternative embodiments, the aforementioned second conductive via element 132 is omitted, such that the first end 181 of the second parasitic radiation element 180 is adjacent to the third grounding point GP3 but does not directly touch the ground plane 140. The two different designs can achieve similar operation performance since there is a coupling effect induced between the second parasitic radiation element 180 and the ground plane 140.

At least one portion of the additional radiation element 190 may substantially have a straight-line shape, which may be substantially parallel to the slot 120. The additional radiation element 190 has a first end 191 and a second end 192. The first end 191 of the additional radiation element 190 is an open end. The second end 192 of the additional radiation element 190 is adjacent to or is coupled to the feeding radiation element 150. For example, the additional radiation element 190 may further include a second widening portion 195, which may be positioned at the second end 192 of the additional radiation element 190 and may substantially have an L-shape or a rectangular shape. The second widening portion 195 has a vertical projection on the second surface E2 of the dielectric substrate 130. The vertical projection of the second widening portion 195 may at least partially overlap the wide portion 152 of the feeding radiation element 150. In some embodiments, the whole additional radiation element 190 is floating. The second end 192 of the additional radiation element 190 is an open end, which is adjacent to the wide portion 152 of the feeding radiation element 150 but does not directly touch the feeding radiation element 150. However, the invention is not limited thereto. In alternative embodiments, the mobile device 100 further includes a third conductive via element (not shown). The third conductive via element penetrates the dielectric substrate 130, and thus the second end 192 or the second widening portion 195 of the additional radiation element 190 is coupled through the third conductive via element to the wide portion 152 of the feeding radiation element 150. The two different designs can achieve similar operation performance since there is a coupling effect induced between the additional radiation element 190 and the feeding radiation element 150.

Figure 2:
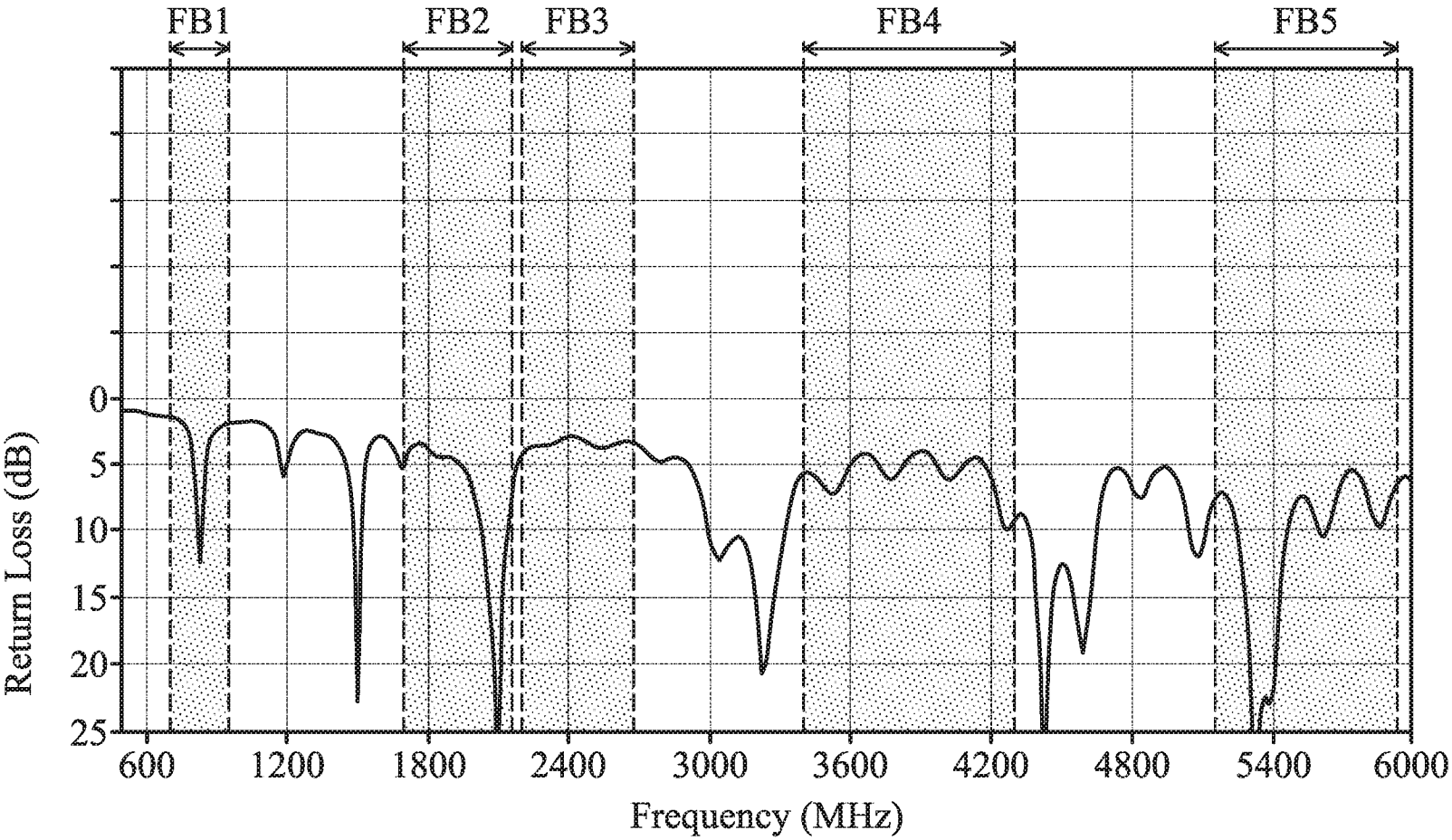
FIG. 2 is a diagram of return loss of an antenna structure of a mobile device according to an embodiment of the invention.

FIG. 2 is a diagram of return loss of the antenna structure of the mobile device 100 according to an embodiment of the invention. According to the measurement of FIG. 2, the antenna structure of the mobile device 100 covers a first frequency band FB1, a second frequency band FB2, a third frequency band FB3, a fourth frequency band FB4, and a fifth frequency band FB5. The first frequency band FB1 may be from 699 MHz to 960 MHz. The second frequency band FB2 may be from 1710 MHz to 2170 MHz. The third frequency band FB3 may be from 2200 MHz to 2690 MHz. The fourth frequency band FB4 may be from 3400 MHz to 4300 MHz. The fifth frequency band FB5 may be from 5150 MHz to 5925 MHz. Therefore, the antenna structure of the mobile device 100 can support at least the multiband operations of LTE (Long Term Evolution).

With respect to the antenna theory, the feeding radiation element 150 and the slot 120 of the metal mechanism element 110 can be excited to generate the first frequency band FB1, the second frequency band FB2, the third frequency band FB3, the fourth frequency band FB4, and the fifth frequency band FB5. The first parasitic radiation element 170 and the second parasitic radiation element 180 are configured to fine-tune the frequency shift amount and the impedance matching of the second frequency band FB2. The additional radiation element 190 is configured to fine-tune the frequency shift amount and the impedance matching of the third frequency band FB3. The fourth frequency band FB4 and the fifth frequency band FB5 are excited and generated because of the double-frequency effect. According to practical measurements, the length L1 of the slot 120 of the metal mechanism element 110 (i.e., the length L1 from the first closed end 121 to the second closed end 122) may be shorter than 0.48 wavelength (0.48λ) of the first frequency band FB1. Therefore, the incorporation of the first parasitic radiation element 170, the second parasitic radiation element 180, the additional radiation element 190, and the circuit element 165 can help to minimize the total size of the antenna structure of the mobile device 100.

Figure 3:
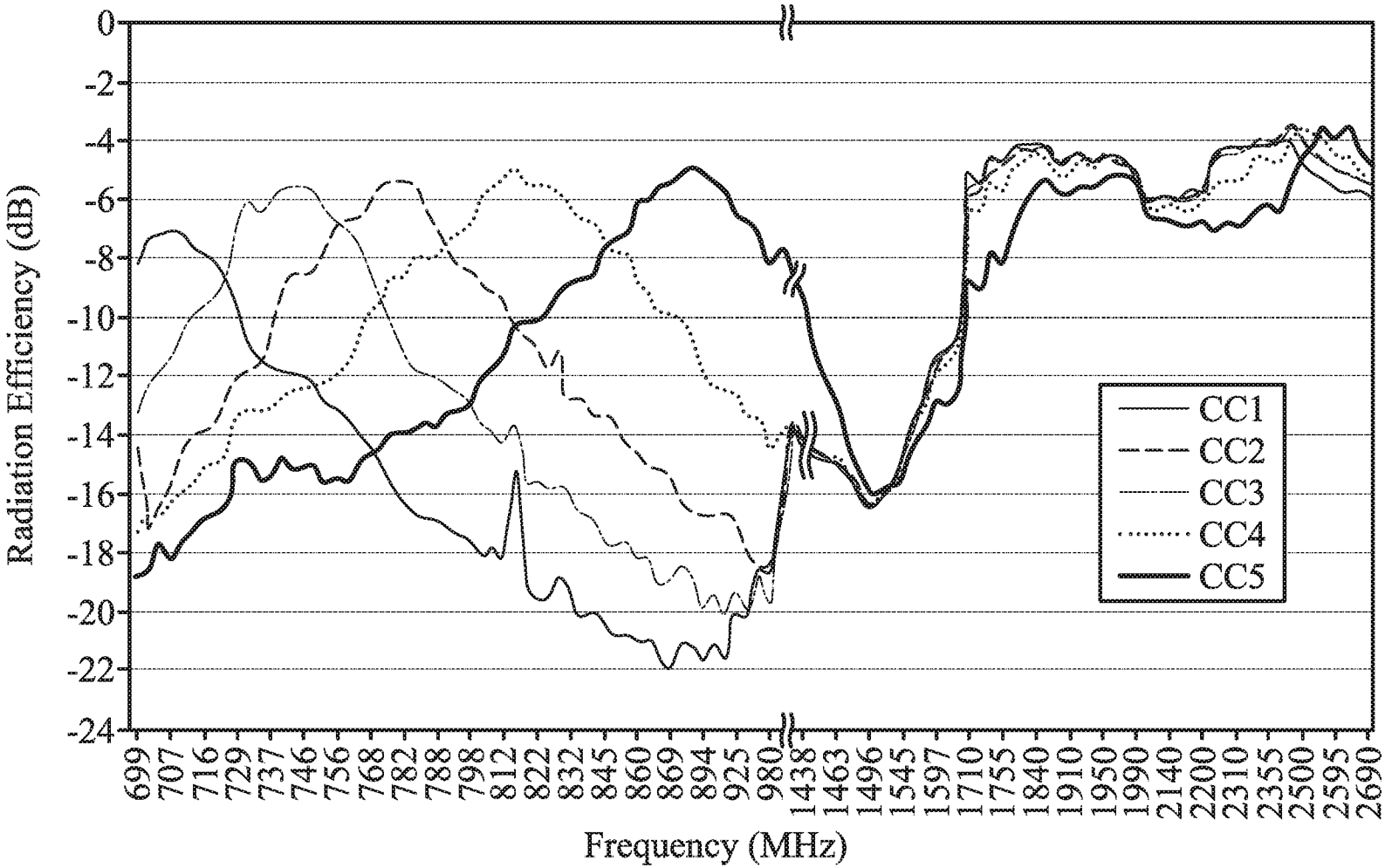
FIG. 3 is a diagram of radiation efficiency of an antenna structure of a mobile device according to an embodiment of the invention.

FIG. 3 is a diagram of radiation efficiency of the antenna structure of the mobile device 100 according to an embodiment of the invention. A first curve CC1 represents the radiation efficiency of the antenna structure when the circuit element 165 has a first impedance value. A second curve CC2 represents the radiation efficiency of the antenna structure when the circuit element 165 has a second impedance value. A third curve CC3 represents the radiation efficiency of the antenna structure when the circuit element 165 has a third impedance value. A fourth curve CC4 represents the radiation efficiency of the antenna structure when the circuit element 165 has a fourth impedance value. A fifth curve CC5 represents the radiation efficiency of the antenna structure when the circuit element 165 has a fifth impedance value. Generally, the capacitive characteristics of the first to fifth impedance values are from the largest to the smallest, and the inductive characteristics of the first to fifth impedance values are from the smallest to the largest. According to the measurement of FIG. 3, the circuit element 165 is configured to change the effective impedance value relative to the slot 120, and thereby mainly adjusting the frequency range of the first frequency band FB1. Specifically, if the capacitance of the circuit element 165 increases, the first frequency band FB1 will become lower, and if the inductance of the circuit element 165 increases, the first frequency band FB1 will become higher. In response to a change in the impedance value of the circuit element 165, the frequency ranges of the second frequency band FB2, the third frequency band FB3, the fourth frequency band FB4, and the fifth frequency band FB5 may be correspondingly adjusted. In some embodiments, the circuit element 165 adjusts its impedance value according to a control signal from a processor (not shown), so as to further increase the operation bandwidth of the antenna structure of the mobile device 100.

In some embodiments, the element sizes of the mobile device 100 are described as follows. The length L1 of the slot 120 may be substantially equal to 0.4 wavelength (0.4λ) of the first frequency band FB1. The width W1 of the slot 120 may be from 2 mm to 4 mm, such as 3 mm. The distance D1 between the feeding point FP and the second closed end 122 of the slot 120 may be from 0.1 to 0.5 times the length L1 of the slot 120, such as 0.25 or 0.33 times the length L1. That is, the feeding point FP is closer to the second closed end 122 of the slot 120 than the first closed end 121 of the slot 120. The length of the first parasitic radiation element 170 (i.e., the length from the first end 171 to the second end 172) may be substantially equal to 0.25 wavelength (λ/4) of the second frequency band FB2. The length of the second parasitic radiation element 180 (i.e., the length from the first end 181 to the second end 182) may be substantially equal to 0.25 wavelength (λ/4) of the second frequency band FB2. The length of the additional radiation element 190 (i.e., the length from the first end 191 to the second end 192) may be substantially equal to 0.25 wavelength (λ/4) of the third frequency band FB3. The thickness H1 of the dielectric substrate 130 may be from 0.1 mm to 5 mm, such as 0.4 mm. The thickness H2 of the holder 115 may be greater than or equal to the thickness H1 of the dielectric substrate 130. The above ranges of element sizes are calculated and obtained according to many experiment results, and they help to optimize the operation bandwidth and impedance matching of the antenna structure of the mobile device 100.

Figure 4A:
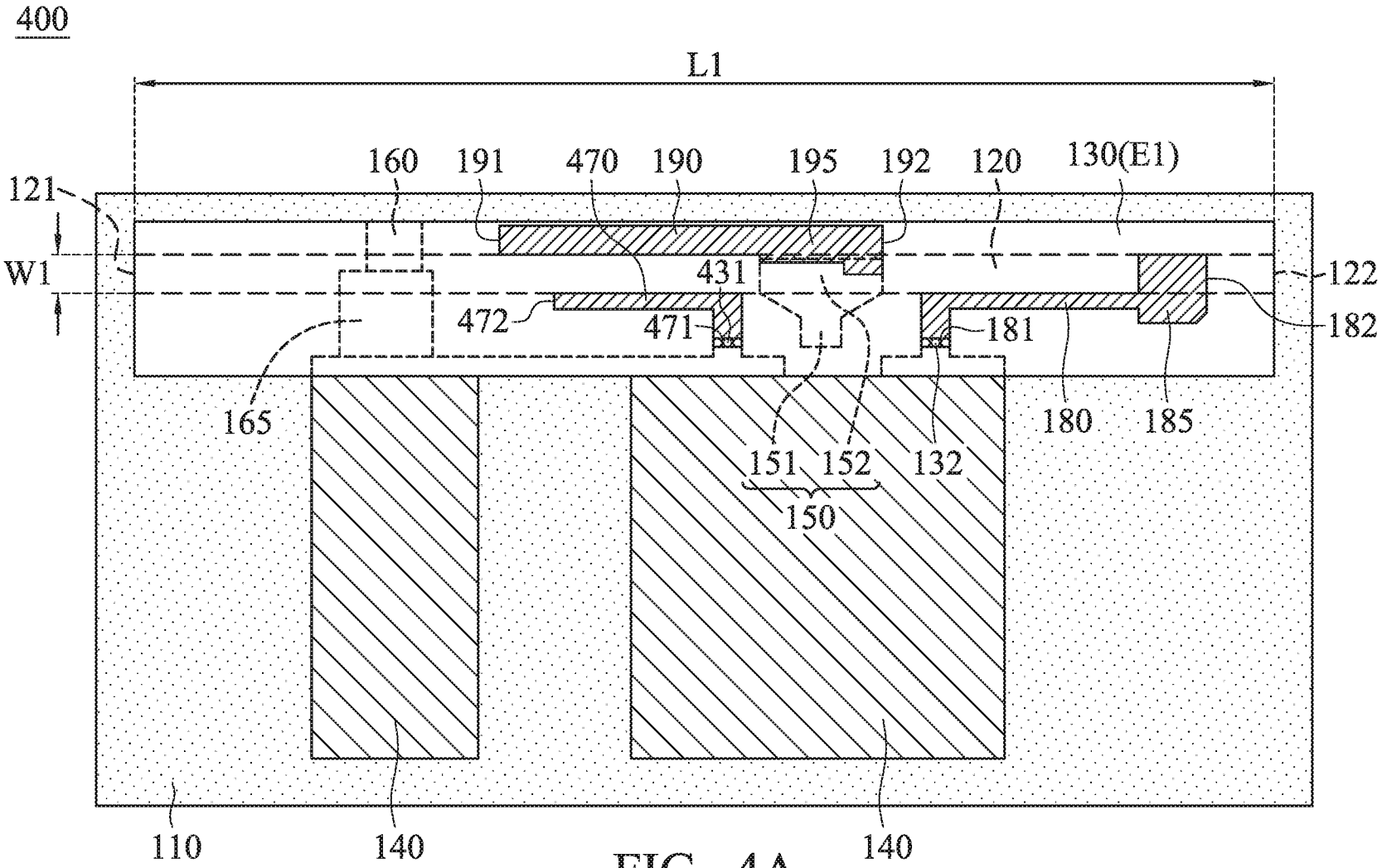
FIG. 4A is a top view of a mobile device according to another embodiment of the invention.
Figure 4B:
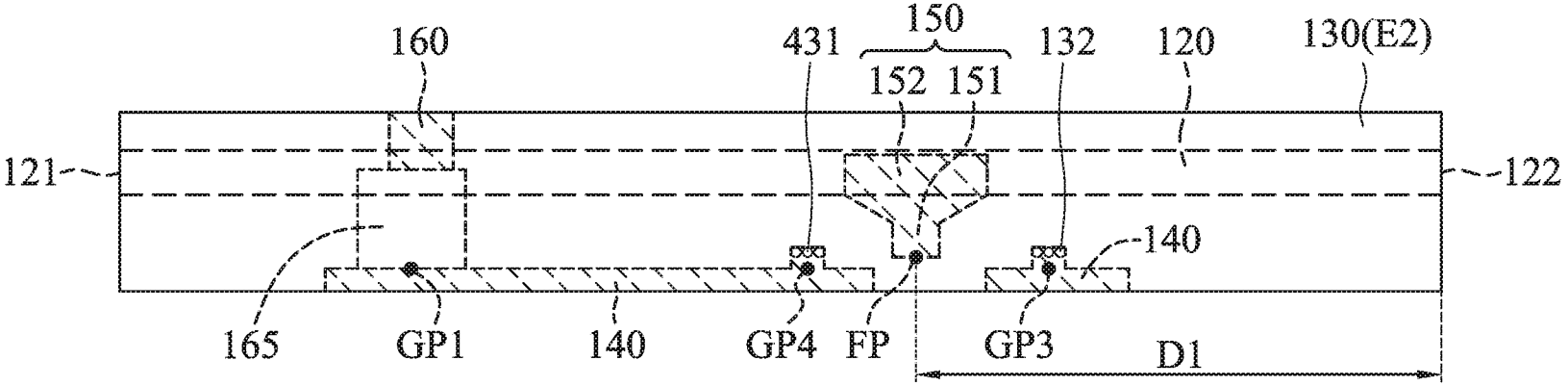
FIG. 4B is a see-through view of a second surface of a dielectric substrate of a mobile device according to another embodiment of the invention.
Figure 4C:
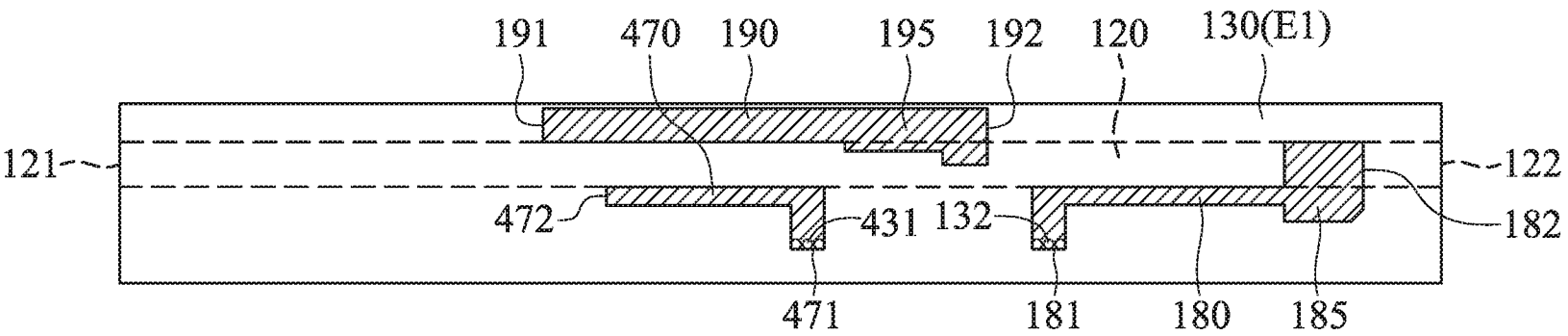
FIG. 4C is a top view of a first surface of a dielectric substrate of a mobile device according to another embodiment of the invention.

FIG. 4A is a top view of a mobile device 400 according to another embodiment of the invention. FIG. 4B is a see-through view of the second surface E2 of the dielectric substrate 130 of the mobile device 400 according to another embodiment of the invention. FIG. 4C is a top view of the first surface E1 of the dielectric substrate 130 of the mobile device 400 according to another embodiment of the invention. Please refer to FIG. 4A, FIG. 4B, and FIG. 4C together. FIG. 4A, FIG. 4B, and FIG. 4C are similar to FIG. 1A, FIG. 1B, and FIG. 1C. In the embodiment of FIG. 4A, FIG. 4B, and FIG. 4C, a first parasitic radiation element 470 of the mobile device 400 substantially has an L-shape, but it has a different arrangement. The first parasitic radiation element 470 is disposed on the first surface E1 of the dielectric substrate 130. The first parasitic radiation element 470 has a first end 471 and a second end 472. The first end 471 of the first parasitic radiation element 470 is coupled to a fourth grounding point GP4 on the ground plane 140. The second end 472 of the first parasitic radiation element 470 is an open end. The fourth grounding point GP4 is closer to the third grounding point GP3 than the second grounding point GP2. The second end 472 of the first parasitic radiation element 470 and the second end 182 of the second parasitic radiation element 180 may extend away from each other. In some embodiments, the mobile device 400 further includes a first conductive via element 431. The first conductive via element 431 penetrates the dielectric substrate 130, and thus the first end 471 of the first parasitic radiation element 470 is coupled through the first conductive via element 431 to the fourth grounding point GP4. In alternative embodiments, the first conductive via element 431 is omitted, such that the first end 471 of the first parasitic radiation element 470 is adjacent to the fourth grounding point GP4 but does not directly touch the ground plane 140. Other features of FIG. 4A, FIG. 4B, and FIG. 4C of the mobile device 400 are similar to those of the mobile device 100 of FIG. 1A, FIG. 1B, and FIG. 1C. Accordingly, the two embodiments can achieve similar levels of performance.

Figure 5A:
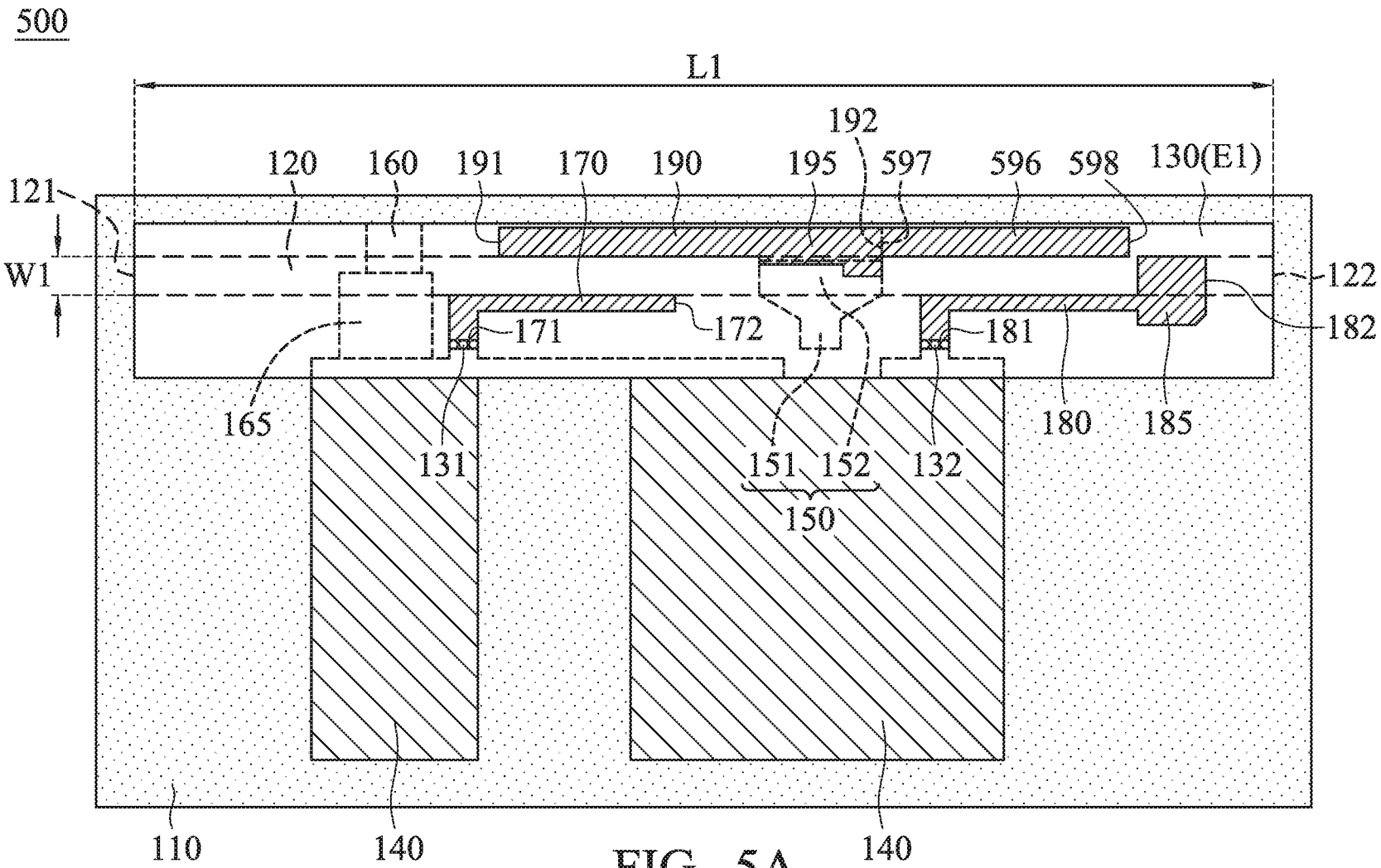
FIG. 5A is a top view of a mobile device according to another embodiment of the invention.
Figure 5B:
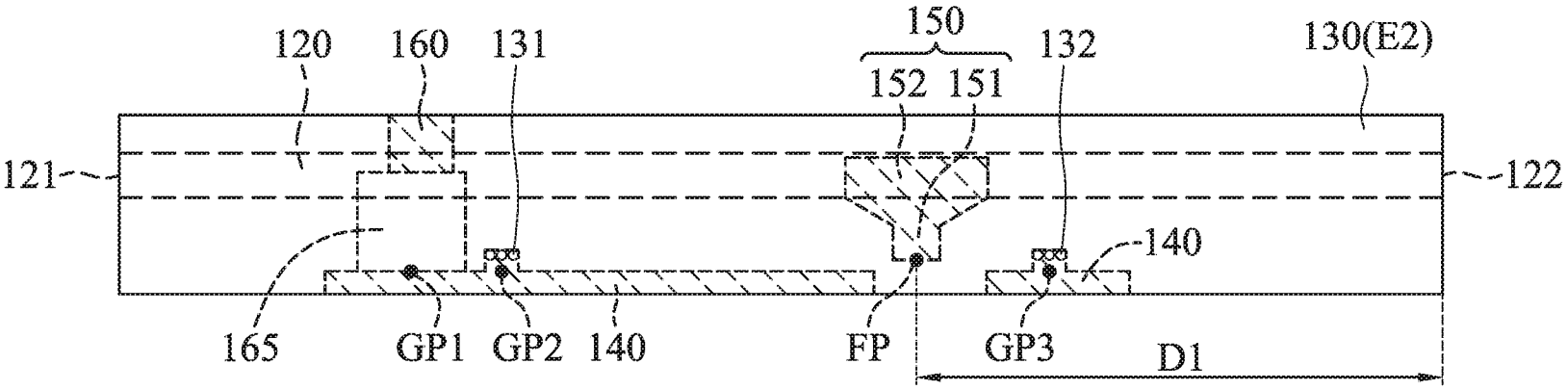
FIG. 5B is a see-through view of a second surface of a dielectric substrate of a mobile device according to another embodiment of the invention.
Figure 5C:
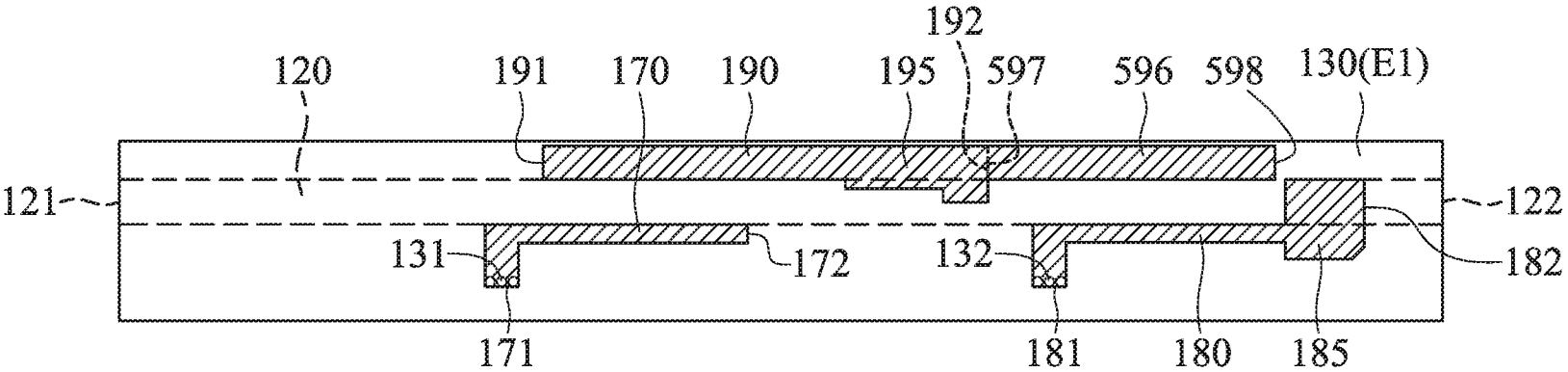
FIG. 5C is a top view of a first surface of a dielectric substrate of a mobile device according to another embodiment of the invention.

FIG. 5A is a top view of a mobile device 500 according to another embodiment of the invention. FIG. 5B is a see-through view of the second surface E2 of the dielectric substrate 130 of the mobile device 500 according to another embodiment of the invention. FIG. 5C is a top view of the first surface E1 of the dielectric substrate 130 of the mobile device 500 according to another embodiment of the invention. Please refer to FIG. 5A, FIG. 5B, and FIG. 5C together. FIG. 5A, FIG. 5B, and FIG. 5C are similar to FIG. 1A, FIG. 1B, and FIG. 1C. In the embodiment of FIG. 5A, FIG. 5B, and FIG. 5C, the mobile device 500 further includes an auxiliary radiation element 596, which is made of a metal material. The auxiliary radiation element 596 is disposed on the first surface E1 of the dielectric substrate 130. The auxiliary radiation element 596 may substantially have a straight-line shape. The auxiliary radiation element 596 has a first end 597 and a second end 598. The first end 597 of the auxiliary radiation element 596 is coupled to the second end 192 of the additional radiation element 190. The second end 598 of the auxiliary radiation element 596 is an open end, which extends away from the additional radiation element 190. The auxiliary radiation element 596 has a vertical projection on the metal mechanism element 110. The vertical projection of the auxiliary radiation element 596 may at least partially overlap the slot 120 of the metal mechanism element 110, or may not overlap the slot 120 of the metal mechanism element 110 at all. According to practical measurements, the incorporation of the auxiliary radiation element 596 can further increase the operation bandwidth of the antenna structure of the mobile device 500. Other features of FIG. 5A, FIG. 5B, and FIG. 5C of the mobile device 500 are similar to those of the mobile device 100 of FIG. 1A, FIG. 1B, and FIG. 1C. Accordingly, the two embodiments can achieve similar levels of performance.

Figure 6:
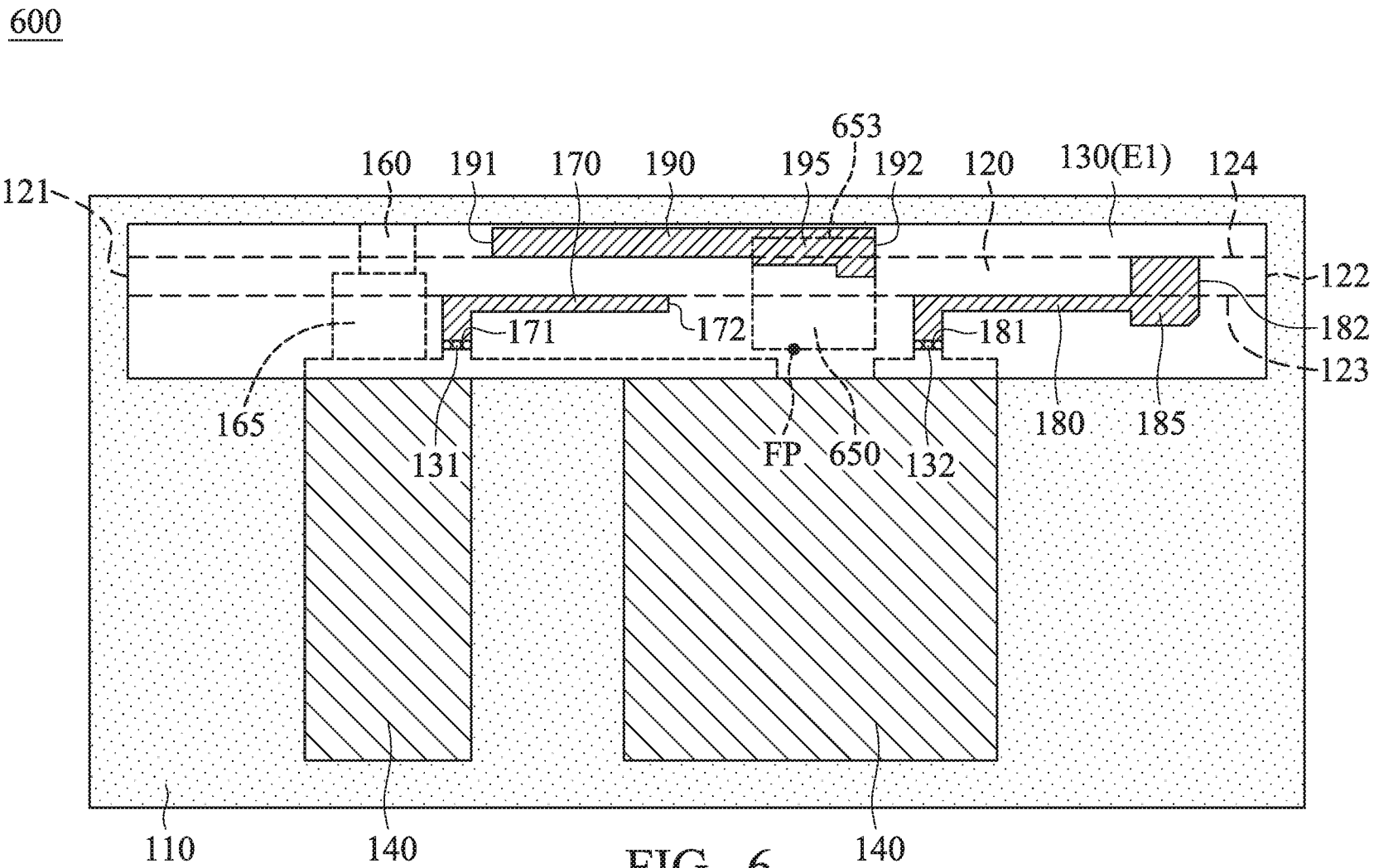
FIG. 6 is a top view of a mobile device according to another embodiment of the invention.

FIG. 6 is a top view of a mobile device 600 according to another embodiment of the invention. FIG. 6 is similar to FIG. 1A. In the embodiment of FIG. 6, a feeding radiation element 650 of the mobile device 600 substantially has a rectangular shape. The feeding radiation element 650 extends across both the first side 123 and the second side 124 of the slot 120. Specifically, the feeding radiation element 650 has a specific side 653 which is far away from the feeding point FP. The specific side 653 is substantially aligned with at least one side of the additional radiation element 190. That is, the feeding radiation element 650 and the additional radiation element 190 are two elements having the same visual heights. Such a design can fine-tune the coupling amount of the feeding radiation element 650, so as to control the low-frequency impedance matching and operation frequency shift of the antenna structure of the mobile device 600. Other features of the mobile device 600 of FIG. 6 are similar to those of the mobile device 100 of FIG. 1A, FIG. 1B, and FIG. 1C. Accordingly, the two embodiments can achieve similar levels of performance.

Figure 7:
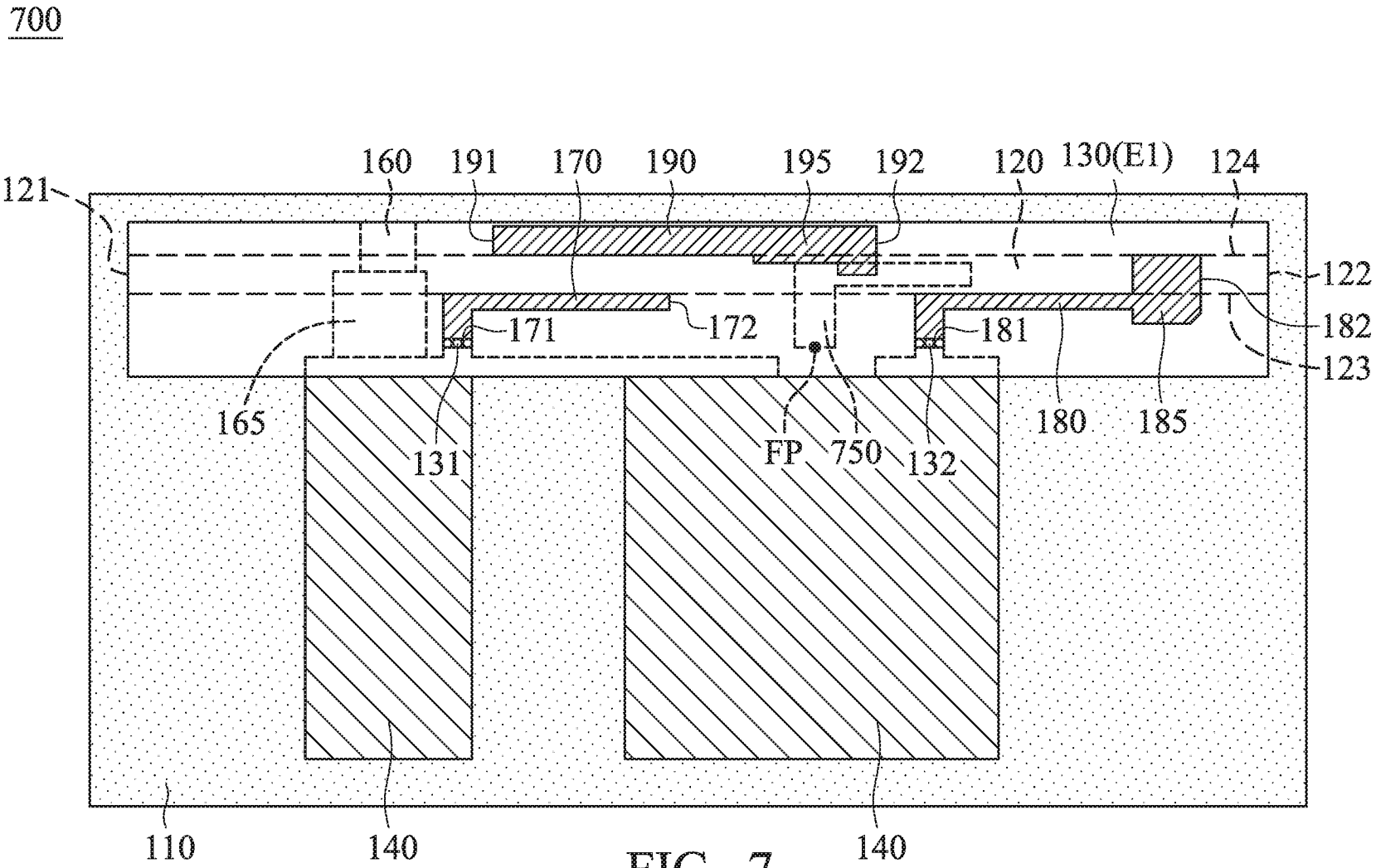
FIG. 7 is a top view of a mobile device according to another embodiment of the invention.

FIG. 7 is a top view of a mobile device 700 according to another embodiment of the invention. FIG. 7 is similar to FIG. 1A. In the embodiment of FIG. 7, a feeding radiation element 750 of the mobile device 700 substantially has a relatively small L-shape. Specifically, the feeding radiation element 750 extends across only the first side 123 of the slot 120, but does not extend across the second side 124 of the slot 120. Such a design can fine-tune the coupling amount of the feeding radiation element 750, so as to control the low-frequency impedance matching and operation frequency shift of the antenna structure of the mobile device 700. Other features of the mobile device 700 of FIG. 7 are similar to those of the mobile device 100 of FIG. 1A, FIG. 1B, and FIG. 1C. Accordingly, the two embodiments can achieve similar levels of performance.

Figure 8:
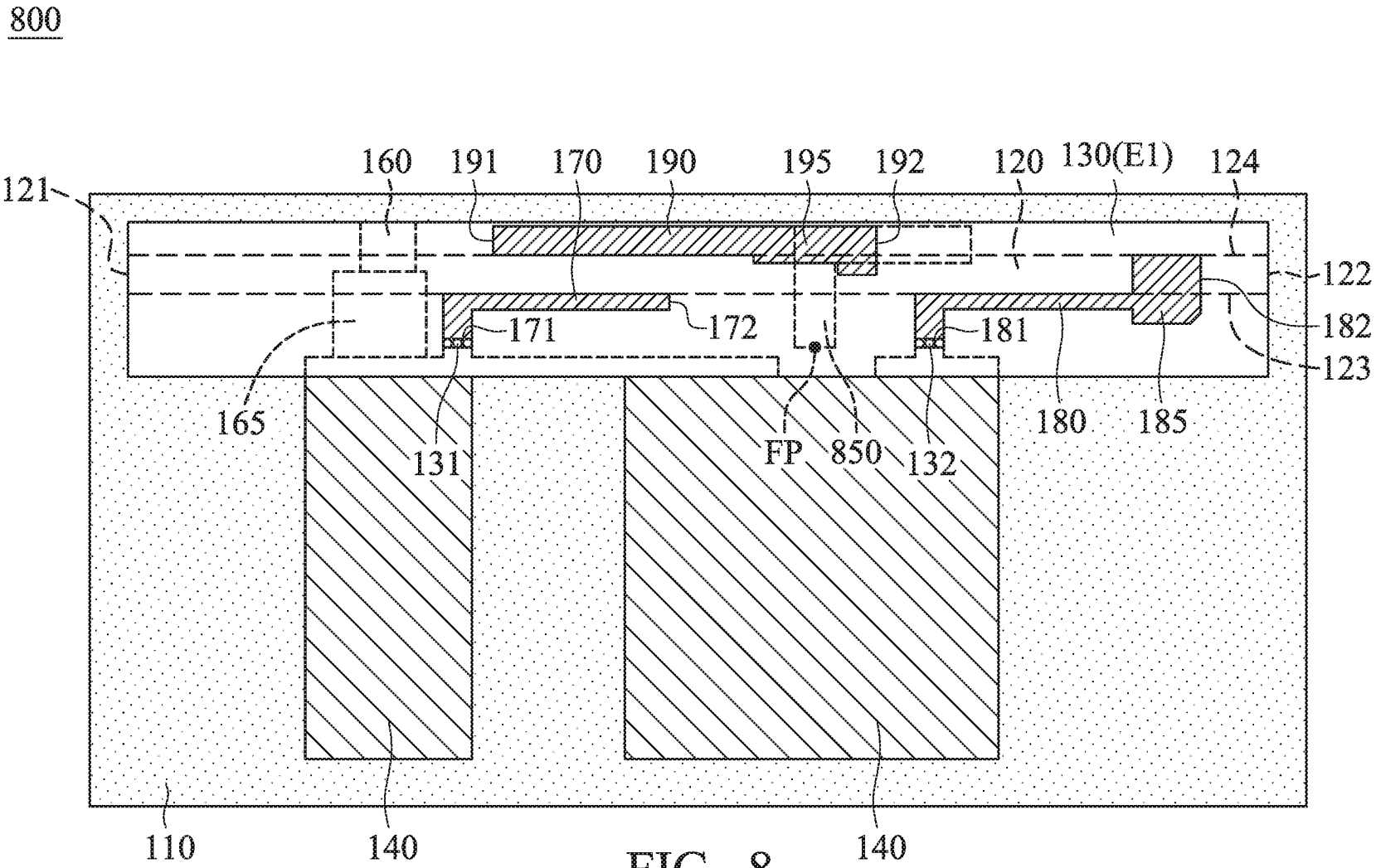
FIG. 8 is a top view of a mobile device according to another embodiment of the invention.

FIG. 8 is a top view of a mobile device 800 according to another embodiment of the invention. FIG. 8 is similar to FIG. 1A. In the embodiment of FIG. 8, a feeding radiation element 850 of the mobile device 800 substantially has a relatively large L-shape. Specifically, the feeding radiation element 850 extends across both the first side 123 and the second side 124 of the slot 120. Such a design can fine-tune the coupling amount of the feeding radiation element 850, so as to control the low-frequency impedance matching and operation frequency shift of the antenna structure of the mobile device 800. Other features of the mobile device 800 of FIG. 8 are similar to those of the mobile device 100 of FIG. 1A, FIG. 1B, and FIG. 1C. Accordingly, the two embodiments can achieve similar levels of performance.

The invention proposes a novel mobile device and a novel antenna structure, which are integrated with a metal mechanism element. The metal mechanism element does not negatively affect the radiation performance of the antenna structure because the metal mechanism element is considered as an extension portion of the antenna structure. Furthermore, because of the incorporation of the first parasitic radiation element, the second parasitic radiation element, the additional radiation element, and the circuit element, the slot length of the antenna structure of the invention does not necessarily reach 0.5 wavelength of the corresponding operation frequency. Such a design can minimize the total antenna size. In comparison to the conventional design, the invention has at least the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the mobile device and antenna structure of the invention are not limited to the configurations of FIGS. 1-8. The invention may merely include any one or more features of any one or more embodiments of FIGS. 1-8. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a metal mechanism element, having a slot, wherein the slot has a first closed end and a second closed end;

a dielectric substrate, having a first surface and a second surface opposite to each other;

a holder, disposed on the metal mechanism element, and configured to support the dielectric substrate;

a feeding radiation element, having a feeding point, and covering at least a portion of the slot;

a ground plane, coupled to the metal mechanism element;

a shorting element, coupled to the metal mechanism element;

a circuit element, coupled between the shorting element and a first grounding point on the ground plane, wherein the feeding radiation element, the ground plane, the shorting element, and the circuit element are disposed on the second surface of the dielectric substrate;

a first parasitic radiation element, coupled to a second grounding point on the ground plane;

a second parasitic radiation element, coupled to a third grounding point on the ground plane; and an additional radiation element, disposed adjacent to or coupled to the feeding radiation element, wherein the first parasitic radiation element, the second parasitic radiation element, and the additional radiation element are disposed on the first surface of the dielectric substrate;

wherein an antenna structure is formed by the feeding radiation element, the radiation element, the additional radiation element, and the slot of the metal mechanism element.

2. The mobile device as claimed in claim 1, wherein each of the ground plane and the shorting element is a ground copper foil extending from the metal mechanism element onto the second surface of the dielectric substrate.

3. The mobile device as claimed in claim 1, wherein the feeding radiation element substantially has a geometric shape.

4. The mobile device as claimed in claim 1, wherein the slot has a first side and a second side opposite to each other, and the feeding radiation element extends across at least the first side of the slot.

5. The mobile device as claimed in claim 1, wherein the feeding radiation element has a specific side away from the feeding point, and the specific side is substantially aligned with at least a side of the additional radiation element.

6. The mobile device as claimed in claim 1, further comprising:

a first conductive via element, penetrating the dielectric substrate, wherein the first parasitic radiation element is coupled through the first conductive via element to the second grounding point.

7. The mobile device as claimed in claim 6, further comprising:

a second conductive via element, penetrating the dielectric substrate, wherein the second parasitic radiation element is coupled through the second 4 conductive via element to the third grounding point.

8. The mobile device as claimed in claim 1, wherein at least one of the first parasitic radiation element and the second parasitic radiation element substantially has an L-shape.

9. The mobile device as claimed in claim 1, wherein the second parasitic radiation element further comprises a first widening portion, and the first widening portion covers at least a portion of the slot.

10. The mobile device as claimed in claim 9, wherein the additional radiation element further comprises a second widening portion, the second widening portion has a vertical projection on the second surface of the dielectric substrate, and the vertical projection at least partially overlaps the feeding radiation element.

11. The mobile device as claimed in claim 1, wherein at least a portion of the additional radiation element substantially has a straight-line shape substantially parallel to the slot.

12. The mobile device as claimed in claim 1, wherein the additional radiation element is floating and does not directly touch the feeding radiation element.

13. The mobile device as claimed in claim 1, wherein the antenna structure covers a first frequency band, a second frequency band, a third frequency band, a fourth frequency band, and a fifth frequency band, and wherein the first frequency band is from 699 MHz to 960 MHz, the second frequency band is from 1710 MHz to 2170 MHz, the third frequency band is from 2200 MHz to 2690 MHz, the fourth frequency band is from 3400 MHz to 4300 MHz, and the fifth frequency band is from 5150 MHz to 5925 MHz.

14. The mobile device as claimed in claim 13, wherein a length of the slot is shorter than 0.48 wavelength of the first frequency band.

15. The mobile device as claimed in claim 13, wherein a length of the first parasitic radiation element is substantially equal to 0.25 wavelength of the second frequency band.

16. The mobile device as claimed in claim 13, wherein a length of the second parasitic radiation element is substantially equal to 0.25 wavelength of the second frequency band.

17. The mobile device as claimed in claim 13, wherein a length of the additional radiation element is substantially equal to 0.25 wavelength of the third frequency band.

18. The mobile device as claimed in claim 1, wherein the circuit element is a resistor, an inductor, a capacitor, a switch element, or a combination thereof.

19. The mobile device as claimed in claim 1, further comprising:

an auxiliary radiation element, coupled to the additional radiation element, and disposed on the first surface of the dielectric substrate, wherein the auxiliary radiation element substantially has a straight-line shape.

20. An antenna structure, comprising:

a metal mechanism element, having a slot, wherein the slot has a first closed end and a second closed end;

a dielectric substrate, having a first surface and a second surface opposite to each other;

a holder, disposed on the metal mechanism element, and configured to support the dielectric substrate;

a feeding radiation element, having a feeding point, and covering at least a portion of the slot;

a ground plane, coupled to the metal mechanism element;

a shorting element, coupled to the metal mechanism element;

a circuit element, coupled between the shorting element and a first grounding ground plane, the shorting element, and the circuit element are disposed on the second surface of the dielectric substrate;

a first parasitic radiation element, coupled to a second grounding point on the ground plane;

a second parasitic radiation element, coupled to a third grounding point on the ground plane; and an additional radiation element, disposed adjacent to or coupled to the feeding radiation element, wherein the first parasitic radiation element, the second parasitic radiation element, and the additional radiation element are disposed on the first surface of the dielectric substrate.

* * * * *